US006422164B1

(12) United States Patent
Gries et al.

(10) Patent No.: US 6,422,164 B1
(45) Date of Patent: Jul. 23, 2002

(54) SEWING MACHINE WITH THREAD WITHDRAWING DEVICE

(75) Inventors: Franz Gries, Trippstadt; Hermann Rutz, Weselberg, both of (DE)

(73) Assignee: G.M. Pfaff Aktiengesellschaft In Insolvenz (DE)

( * ) Notice: Subject to any disclaimer, the term of this patent is extended or adjusted under 35 U.S.C. 154(b) by 0 days.

(21) Appl. No.: 09/913,998

(22) PCT Filed: Dec. 21, 2000

(86) PCT No.: PCT/EP00/13072

§ 371 (c)(1),
(2), (4) Date: Aug. 20, 2001

(87) PCT Pub. No.: WO01/46508

PCT Pub. Date: Jun. 28, 2001

(30) Foreign Application Priority Data

Dec. 22, 1999 (DE) ..... 299 22 786 U

(51) Int. Cl.[7] ..... D05B 49/00
(52) U.S. Cl. ..... 112/286

(58) Field of Search ..... 112/286, 241, 112/285, 254

(56) References Cited

U.S. PATENT DOCUMENTS

| | | | | | |
|---|---|---|---|---|---|
| 3,640,236 | A | * | 2/1972 | Nicolay | 112/286 |
| 3,901,171 | A | * | 8/1975 | Rosa | 112/286 |
| 5,044,290 | A | * | 9/1991 | Sato et al. | 112/286 |
| 5,404,824 | A | * | 4/1995 | Hiraoka et al. | 112/254 |

* cited by examiner

*Primary Examiner*—Ismael Izaguirre
(74) *Attorney, Agent, or Firm*—McGlew and Tuttle, P.C.

(57) ABSTRACT

A sewing machine has a thread pull-away mechanism (24), which prevents the needle thread end from being jammed under the presser foot (9) at the beginning of a sewing operation. The thread pull-away mechanism (24) has a pin (22) with a thread eye (23), which extends at right angles to the path of the needle thread (27) extending between two thread guides (25, 26) and can be moved through at right angles to the path of the needle thread (27) between an inoperative position and a functional position.

9 Claims, 1 Drawing Sheet

3
21
20
12
16
18
13
24
22
23

3
21
20
18
19
17
24
15
16
14
13
12
23

6
7
15
13
24
23
27
1
10
21
25
23
26
4
5
8
9
11
3
2

SEWING MACHINE WITH THREAD WITHDRAWING DEVICE

FIELD OF THE INVENTION

The present invention pertains to a sewing machine with a needle bar which can be moved up and down with a thread-guiding needle, with a thread take-up lever, at least one thread-tensioning device, with a pressure bar which can be moved up and down between an inoperative position and a pressing position with a presser foot which can be lowered onto a fabric support surface, with a shuttle, which is arranged under the fabric support surface and cooperates with the needle, with a thread-cutting device provided at least for cutting the needle thread and with a device for pulling away the reserve-side needle thread end, which can be actuated after the thread-cutting operation.

BACKGROUND OF THE INVENTION

When the presser foot of the sewing machine is lowered onto the fabric before the beginning of a sewing operation, the thread end hanging down from the needle should not be located under the presser foot because there is otherwise a risk that the thread end is jammed between the presser foot and the fabric. The consequence of this would be that the thread end could not be pulled to the underside of the fabric at the beginning of the sewing operation but would remain on the top side as a sticking-out thread end impairing the appearance of the seam.

To prevent this, it has been known, e.g., from DE 25 26 694 C2 (U.S. Pat. No. 3,901,171) that the needle thread end is moved out of the area of the presser foot by means of a take-up sweep assembly designed as a thread sweep, which is moved through between the presser foot and the needle. Such take-up sweep assemblies operate very reliably and are therefore frequently used. However, their use is limited during the processing of very thick materials, e.g., padding, because the distance between the presser foot and the needle, which is in the raised position, may be so narrow that no sufficient space is available for the passage of the thread sweep.

In contrast, such take-up sweep assemblies, in which the needle thread end is moved out of the area of the presser foot by a compressed air stream rather than by a mechanical thread sweep, can be used during the processing of thick materials. Such a take-up sweep assembly has been known, e.g., from U.S. Pat. No. 3,371,632. However, such means are disadvantageous compared with mechanically operating means because resistant threads, which may additionally also be twisted, may sometimes be pulled away from the area of the presser foot only insufficiently and the means also have a comparatively high compressed air and consequently energy consumption.

SUMMARY AND OBJECTS OF THE INVENTION

The basic object of the present invention is to provide a take-up sweep assembly which can be used for processing both thin and especially thick materials without limitations.

According to the invention, a sewing machine is provided with a needle bar which can be moved up and down with a thread-guiding needle, with a thread take-up lever, with at least one thread-tensioning device, with a pressure bar which can be moved up and down between an inoperative position and a pressing position with a presser foot which can be lowered onto a fabric support surface and with a shuttle, which is arranged under the fabric support surface and cooperates with the needle. A thread-cutting device is provided at least for cutting the needle thread. A device for pulling away the reserve-side needle thread end, which device can be actuated after the thread-cutting operation is also provided. The device for pulling away the needle thread end is formed by a pin, which extends at right angles to the path of the needle thread. The pin extends between two thread guides and can be moved essentially at right angles through the path of the needle thread between an inoperative position and a functional position. The movement of the pin from the inoperative position into the functional position takes place after a thread-cutting operation. The thread-tensioning device is put in operation and moved back into the inoperative position before a repeated sewing start.

The present invention is based on the idea that the needle thread end is retracted through the eye of the needle by the pin, which can be moved at right angles to the path of the needle thread, just so much that the presser foot cannot be jammed between the presser foot and the fabric during the lowering of the thread end, on the one hand, and the thread end hanging down from the eye of the needle still has a sufficient length for satisfactory thread knotting at the beginning of the next sewing operation. One essential requirement for reliable thread knotting is that the retracted amount of thread is released before the next start of sewing and is thus available as a free thread reserve.

A take-up sweep assembly which also has a thread retracting pin movable at right angles to the path of the needle thread besides a thread sweep has been known from DE-GM 75 01 449 (U.S. Pat. No. 3,847,102). This thread retracting pin, which can be moved simultaneously with the thread sweep, supports the action of the thread sweep, which performs only a comparatively small pivoting movement, by additionally retracting a small amount of thread through the eye of the needle. Since this thread retracting pin is thus used only as an auxiliary means, the thread sewing machine has besides a thread pull-away mechanism proper, namely, the thread sweep, by shortening the thread end that may not have been removed far enough from the presser foot by the thread sweep to the extent that it cannot be jammed under the presser foot any more, the DE-GM could not have suggested the inventive idea, namely, the provision of a take-up sweep assembly that has only a thread retracting pin.

The fact that the measure according to the present invention, namely, the prevention of the jamming of the needle thread end solely by shortening the thread end, cannot have been obvious arises especially from the fact that DE-OS 1 933 780 (U.S. Pat. No. 3,540,235) and DE 22 07 366 B2 (U.S. Pat. No. 3,695,200) propose that an additional thread reserve be made available for reliable thread knotting at the beginning of the next sewing operation in case of the use of a thread sweep, even though the length of the thread end hanging down from the eye of the needle remained unaffected by a thread sweep and the thread knotting at the beginning of the next sewing operation is therefore not compromised. This thread reserve is produced by the fact that a thread pull-off pin which can be moved at right angles to the needle thread pulls off a certain amount of thread before the thread cutting from the thread reserve through the opened thread-tensioning device and releases it again before the next start of sewing.

The invention may be employed with an angle lever having one arm which carries the pin and another arm which is connected to a drive arranged within the head cover. The angle lever may be mounted on a bolt arranged on the head cover of the machine housing.

The drive may be arranged on a carrier fastened adjustably within the head cover. A compressed air cylinder or an electromagnet may be used as the drive.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
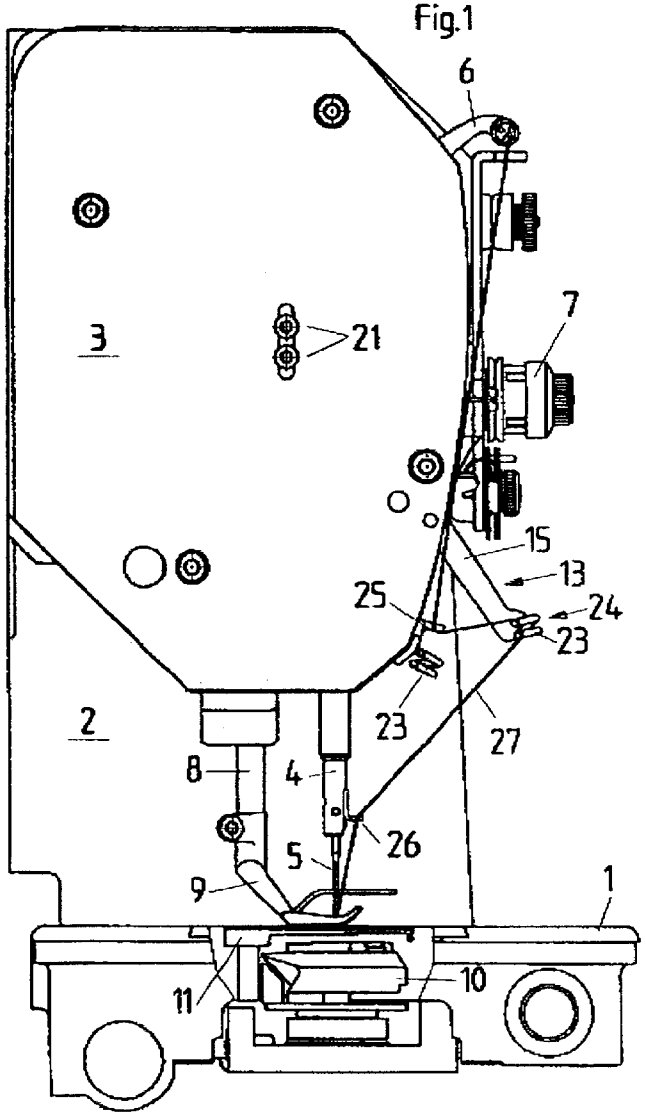
FIG. 1 is a side view of a sewing machine according to the invention.

Referring to the drawings in particular, FIG. 1 shows a sewing machine according to the invention with the base plate designated by 1, the housing base designated by 2, and the head cover closing the housing head designated by 3.

In the manner known per se, the sewing machine has a needle bar 4 which can be moved up and down with a thread-guiding needle 5, a take-up lever 6, a thread-tensioning device 7, and a pressure bar 8 movable up and down between an inoperative position and a pressing position with a presser foot 9. A shuttle or hook or looper 10 cooperating with the needle 5 as well as a thread-cutting means 11 are arranged in the base plate 1.

An angle lever 13, whose arms are designated by 14 and 15, is mounted on a bolt 12 on the inside of the head cover 3. The arm 14 is in drive connection with a compressed air cylinder 16 by a hinge pin 17, which is mounted in a fork head 18 fastened to the piston rod, engaging a slot 19 of the arm 14. The compressed air cylinder 16 is arranged on an angle-shaped carrier 20, whose height can be adjusted on the head cover 3 by means of screws 21.

A thread retracting pin 22, which projects at right angles and whose free end is shaped to form a thread eye 23, is fastened at the end of the arm 15. The compressed air cylinder 16 and the angle lever 13 form together a thread pull-away mechanism 24.

Figure 3:
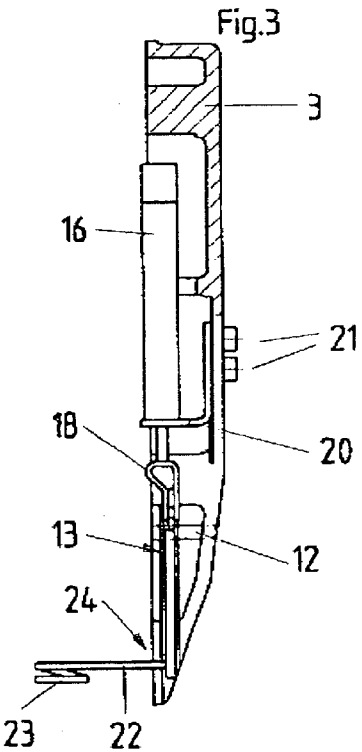
FIG. 3 is a sectional view of the head cover.
Figure 2:
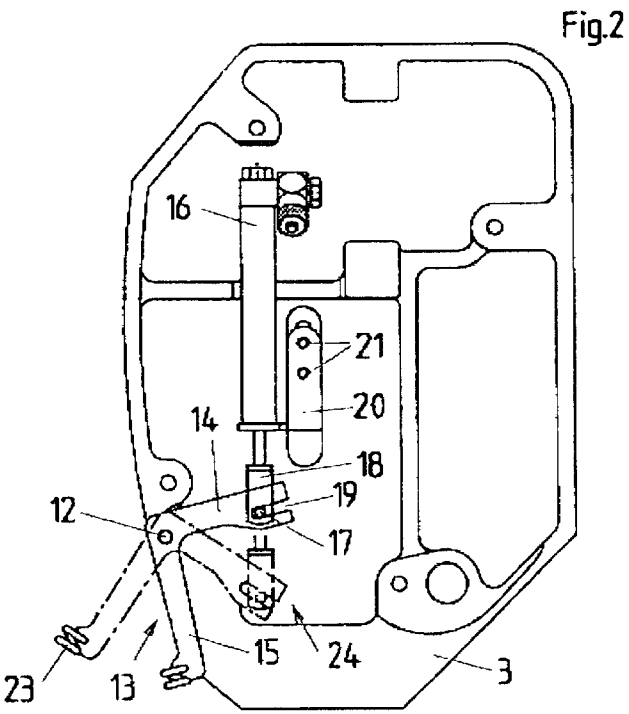
FIG. 2 is a view of the inside of the head cover of the sewing machine of FIG. 1.

According to FIG. 2, the angle lever 13 can be pivoted to and fro between an inoperative position indicated by solid line and a functional position represented by dash-dotted line. In the inoperative position, the thread retracting pin 22 with the thread eye 23 is located between a thread eye 25 fastened to the housing head and a thread eye 26 arranged on the needle bar 4. In this position, the needle thread 27 arriving from the take-up lever 6 runs essentially in parallel from the upper thread eye 25 through the thread eye 23 of the thread retracting pin 22 and to the lower thread eye 26 on the needle bar 4.

The angle lever 23 remains in its inoperative position during sewing. Pressure is admitted to the compressed air cylinder 16 only at the end of a seam after thread cutting with the thread-tensioning device 7 in operation, as a result of which it pivots the angle lever 13 from the inoperative position into the functional position. The thread retracting pin 22 now moves at right angles to the path of the needle thread 27 defined by the two thread eyes 25, 26, as a result of which it pulls out the needle thread at an angle, as is shown in FIG. 1. Since the needle thread 27 is now held in the thread-tensioning device 7 in a frictionally engaged manner, the thread retracting pin 22 retracts thread through the thread eye 26 of the needle bar 4 and through the eye of the needle 5, which is not provided specifically with a reference number, against the normal thread pull-off direction and thus shortens the thread end hanging down from the eye of the needle. By adjusting the carrier 20, the location of the inoperative position and of the functional position of the angle lever 13 can be set such that the length of the shortened needle thread end has an optimal value, i.e., it is short enough not to be jammed between the presser foot 9 and the fabric part during the lowering of the presser foot 9 onto a new fabric part, on the one hand, and, on the other hand, it is long enough for reliable thread knotting at the beginning of a new sewing operation. It is very important in this connection that the angle lever 13 be pivoted back into its inoperative position before the beginning of the next sewing operation so that the amount of thread retracted before is now available as a free thread reserve.

While specific embodiments of the invention have been shown and described in detail to illustrate the application of the principles of the invention, it will be understood that the invention may be embodied otherwise without departing from such principles.

What is claimed is:

1. A sewing machine, comprising:

a needle bar which can be moved up and down with a thread-guiding needle;

a thread take-up lever;

at least one thread-tensioning device;

a pressure bar with a presser foot, said pressure bar being movable up and down between an inoperative position and a pressing position with said presser foot being lowerable onto a fabric support surface;

as shuttle arranged under the fabric support surface and cooperating with said needle;

a thread-cutting device for cutting the needle thread;

a reserve-side needle thread end pulling away device actuatable after the thread-cutting operation, said thread end pulling away device including a pin extending at right angles to the path of the needle thread and extending between two thread guides, said pin being movable essentially at right angles through a path of the needle thread between an inoperative position and a functional position, wherein the movement of said pin from the inoperative position into the functional position takes place after a thread-cutting operation with said thread-tensioning device in operation and back into the inoperative position before a repeated sewing start;

a drive arranged within said head cover; and an angle lever including one arm carrying said pin and another arm connected to said drive, said angle lever being mounted on a bolt arranged on said head cover of the machine housing.

2. A sewing machine in accordance with claim 1, wherein said drive is arranged on a carrier fastened adjustably within said head cover.

3. A sewing machine in accordance with claim 2, wherein said drive includes one of a compressed air cylinder and an electromagnet.

4. A sewing machine in accordance with claim 1, wherein said drive includes one of a compressed air cylinder and an electromagnet.

5. A sewing machine, comprising:

a needle bar which can be moved up and down with a thread-guiding needle;

a thread take-up lever;

a thread-tensioning device;

a pressure bar with a presser foot, said pressure bar being movable up and down between an inoperative position and a pressing position with said presser foot being lowerable onto a fabric support surface;

a hook, looper or shuttle arranged under the fabric support surface and cooperating with said needle;

a thread-cutting device for cutting the needle thread;

a pin extending at right angles to the path of the needle thread and extending between two thread guides, said pin being movable essentially at right angles through a path of the needle thread between an inoperative position and a functional position;

a drive arranged within said head cover; and a linkage element connected to said drive and connected to said pin, said linkage element being an angle lever including one arm carrying said pin and another arm connected to said drive, said angle lever being mounted on a bolt arranged on said head cover of the machine housing.

6. A sewing machine in accordance with claim 5, wherein said drive is arranged on a carrier fastened adjustably within said head cover.

7. A sewing machine in accordance with claim 5, wherein said drive includes one of a compressed air cylinder and an electromagnet.

8. A sewing machine, comprising:

a needle bar which can be moved up and down with a thread-guiding needle;

a thread take-up lever;

a thread-tensioning device;

a pressure bar with a presser foot, said pressure bar being movable up and down between an inoperative position and a pressing position with said presser foot being lowerable onto a fabric support surface;

a hook, looper or shuttle arranged under the fabric support surface and cooperating with said needle;

a thread-cutting device for cutting the needle thread;

a pin extending at right angles to the path of the needle thread and extending between two thread guides, said pin being movable essentially at right angles through a path of the needle thread between an inoperative position and a functional position;

a drive arranged within said head cover; and an angle lever including one arm carrying said pin and another arm connected to said drive, said angle lever being mounted on a bolt arranged on said head cover of the machine housing.

9. A sewing machine, comprising:

a needle bar which can be moved up and down with a thread-guiding needle;

a thread take-up lever;

a thread-tensioning device;

a pressure bar with a presser foot, said pressure bar being movable up and down between an inoperative position and a pressing position with said presser foot being lowerable onto a fabric support surface;

a hook, looper or shuttle arranged under the fabric support surface and cooperating with said needle;

a thread-cutting device for cutting the needle thread;

a pin extending at right angles to the path of the needle thread and extending between two thread guides, said pin being movable essentially at right angles through a path of the needle thread between an inoperative position and a functional position;

a drive arranged within said head cover, said drive includes one of a compressed air cylinder and an electromagnet; and a linkage element connected to said drive and connected to said pin.

* * * * *